United States Patent [19]

Broussard

[11] Patent Number: 4,880,229

[45] **Date of Patent: * Nov. 14, 1989**

[54] WEIGHT PLATE FOR EXERCISE DEVICE

[75] Inventor: Robert Broussard, Playa del Rey, Calif.

[73] Assignee: Progressive Health & Fitness, Los Angeles, Calif.

[ * ] Notice: The portion of the term of this patent subsequent to Jul. 12, 2005 has been disclaimed.

[21] Appl. No.: 175,911

[22] Filed: Mar. 31, 1988

Related U.S. Application Data

[63] Continuation-in-part of Ser. No. 830,955, Feb. 19, 1986, Pat. No. 4,756,526.

[51] Int. Cl.[4] ..... A63B 13/00

[52] U.S. Cl. ..... 272/123; 272/122

[58] Field of Search ..... 272/67, 116, 117, 118, 272/112, 122, 123, 124, 127, 128, 148; D21/191, 197

[56] References Cited

U.S. PATENT DOCUMENTS

| | | | |
|---|---|---|---|
| D. 194,042 | 11/1962 | Guthormsen | 272/123 X |
| 2,676,802 | 4/1954 | O'Brien | 272/128 X |
| 3,482,835 | 12/1969 | Dean | 272/128 X |
| 3,913,908 | 10/1975 | Speyer | 272/123 |
| 3,971,555 | 7/1976 | Mahdke | 272/118 |
| 4,231,569 | 11/1980 | Rae | 272/122 |
| 4,369,968 | 1/1983 | Price | 272/123 |
| 4,515,364 | 5/1985 | Rotella | 272/143 |
| 4,625,959 | 12/1986 | Schleffendorf | 272/118 |
| 4,673,179 | 1/1987 | Pengler | 272/122 X |
| 4,756,526 | 7/1988 | Broussard | 272/123 |

*Primary Examiner*—Richard J. Apley
*Assistant Examiner*—Robert W. Bahr
*Attorney, Agent, or Firm*—Ashen Golant Martin & Seldon

[57] ABSTRACT

A weight plate for use with a barbell type exercise device wherein the plate is coupled to the apparatus' lifting bar for rotation during the exercise movement, which rotation is ultimately blocked by a leverage bar coupled to the plate for rotation therewith and positioned to contact the user's outer forearm during the exercise movement.

The plate includes protrusions and recesses on its front and rear faces for interengaging adjacently mounted plates on the apparatus so that the plates rotate together without the need for the leverage bar to penetrate all plates.

12 Claims, 3 Drawing Sheets

FIG. 1
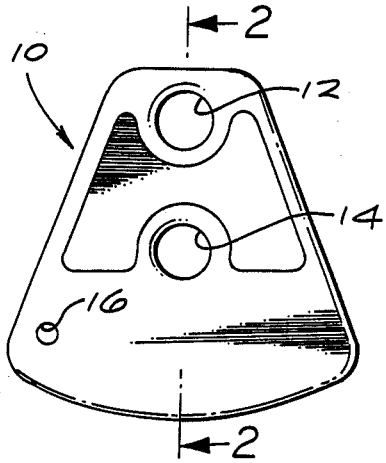
FIG. 4
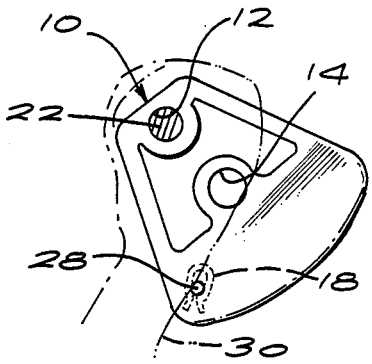
FIG. 5
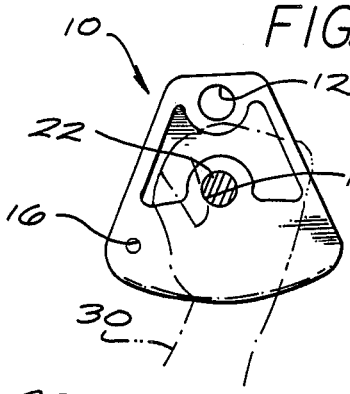
FIG. 2
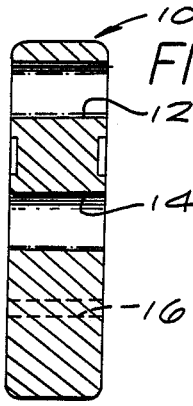
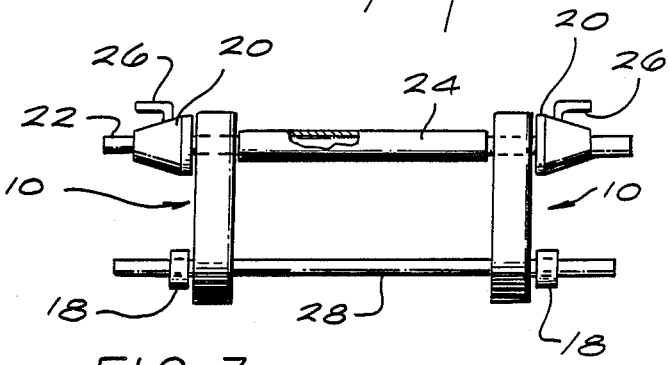
FIG. 3

FIG. 6
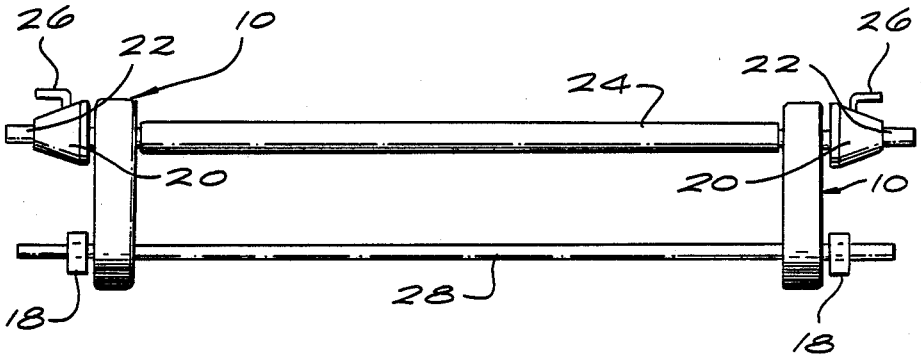
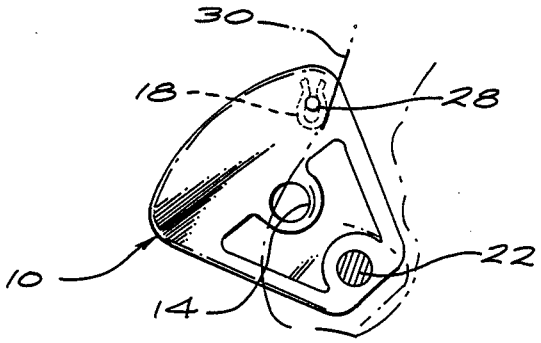
FIG. 7

WEIGHT PLATE FOR EXERCISE DEVICE

This is a continuation-in-part of copending application Ser. No. 830,955 filed on Feb. 19, 1986, now U.S. Pat. No. 4,756,526.

BACKGROUND OF THE INVENTION

The present invention relates to exercising apparatus of the weight lifting type. These types of devices are well known in the art and typically employ such means as one or more weight plates which are lifted by means of a lifting bar. They are commonly referred to as dumb-bells, bar bells, and/or free weights. As used herein, all three terms shall be deemed equivalent.

The present invention is more specifically related to variable resistance exercise devices which compensate for changes in body leverage during an exercise movement. Such leverage changes are caused by the lever effect that a straight line muscle contraction has upon a body part that rotates about a joint.

One limitation associated with the use of barbells as been the loss in resistance that is encountered as the weight approaches a point directly over or under the axis of rotation. In a bicep curl, for example, the substantial portion of the weight is borne by the skeletal structure when the weight is over the elbow. As the curl movement is continued toward the body, the weight actually pulls the arm in the direction of travel.

The search for an exercise device which provides a relatively constant resistance throughout the exercise movement has been substantial. Owing to both leverage changes during the movement, and to the loss in resistance as the weight approaches the aforedescribed position, those skilled in the art have assumed that the barbell has inherently limited utility.

Accordingly, there has been an emphasis recently on expensive and complex equipment utilizing cams or fluid pressure to provide relatively constant resistance and a "smooth" feeling to facilitates maximum stressing of the muscle throughout the exercise movement. However, such equipment has its own limitations in that they work the major muscle groups but ignore the minor muscle groups by restricting movement to a pre-defined arc and eliminating the need to balance the weights during the exercise movement. Additionally, the predefined arc may not match the natural movement of the user.

U.S. Pat. No. 4,231,569 discloses an exercising frame having one end portion which is gripped by the user, a second end portion longitudinally spaced from the first end along a longitudinally extending frame axis and to which a pair of weights are attached, and an intermediate portion therebetween. A handle is rotatably attached to said forst end for rotation of the frame about an axis which is transverse to the frame axis. The intermediate portion contains an arm-engaging surface which keeps the weight from reaching a point above the elbow during the curling movement.

While the device disclosed in the forgoing patent provides resistance throughout a curling movement, it does not compensate for changes in body leverage. Additionally, it represents an extra piece of equipment.

SUMMARY OF THE INVENTION

The present invention is directed to an exercise device which can be used both as a conventional barbell and an improved bar bell wherein relatively constant resistance during an exercise movement provided and changes in body leverage are generally compensated for.

The exercise apparatus disclosed herein comprises weight plate means for providing a movable weight-training mass and having a center of mass. A generally cylindrical lifting bar extends generally longitudinally from the weight plate means and is coupled for rotation with respect thereto at a position offset from said center of mass. A leverage bar extends generally longitudinally from the weight plate means and is coupled thereto for rotation therewith, the leverage bar being positioned to rotate with the weight plate means about the lifting bar so as to contact the outer lower arm of a user after the weight plate means is lifted by the lifting bar.

Weight plate means are provided in the form of a mass of material which including mounting means located at an offset position from the plate's center of gravity for mounting the weight to a lifting bar, and second means positioned on the plate for coupling to a second bar. In the preferred embodiment, the mounting means and second coupling means are simply a pair of aperatures which are sized to receive the lifting bar and leverage bar, respectively.

Further advantages and features of the invention will be more fully apparent to those skilled in the art from the following detailed description of the preferred embodiment, of which the following Drawing is a part.

BRIEF DESCRIPTION OF THE DRAWING

FIG. 1 is a side elevation view of a weight plate constructed in accordance with the invention;

FIG. 2 is a cross section of the weight plate of FIG. 1 taken along line 2—2;

FIG. 3 is a front elevation view of an exercise device constructed in accordance with the invention;

FIG. 4 is a side elevation view depicting one use of an exercise device constructed in accordance with the invention;

FIG. 5 is a side elevation view depicting another use of an exercise device constructed in accordance with the invention;

FIG. 6 is a front elevation view of another exercise device constructed in accordance with the invention;

FIG. 7 is a side elevation view depicting another use of an exercise device constructed in accordance with the invention;

DESCRIPTION OF THE PREFERRED EMBODIMENT

Figure 8:
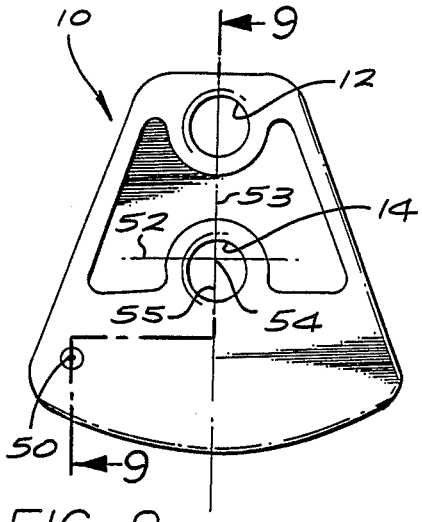
FIG. 8 is a side elevation view of a second embodiment of the weight plate constructed in accordance with the invention.

FIGS. 1 is a front elevation view of a weight plate 10 constructed in accordance with the invention, while FIG. 2 is a cross-sectional view of the weight plate taken along line 2—2 in FIG. 1. The weight plate is in the shape of a truncated isosceles triangle having a rounded base and corners.

The weight 10 has three aperatures 12, 14, 16. Aperture 14 is located at the weight's center of gravity and, as will be discussed below, is sized to mount for rotational movement about a lifting bar.

Aperture 12 is located at a position which is offset from the weight's center of gravity and is also sized to mount for rotational movement around a lifting bar. The aperture 12 is preferably positioned near the top of the weight so that substantially all the weight of the plate 10 will hang below the lifting bar when the aperture 12 is used to mount the plate.

Aperture 16 is located on the side of the plate's center of gravity which is opposite aperature 12. For reasons which will explained, the aperture 16 is located adjacent one of the lower corners of the plate.

FIG. 3 is a front elevation view of an exercise device constructed in accordance with the invention and used for onehanded exercises, while FIG. 6 is a similar view of an exercise device used for two-handed lifting wherein similar components have been identified with like numerals. The exercise device in FIG. 3 comprises a pair of longitudinally-spaced weight plates 10 mounted on opposite end portions of a lifting bar 22 which extend longitudinally therebetween. The lifting bar 22 is slidably received by the aperture 12 (FIG. 1) of each plate, so that the substantial portion of the plates' weight is below the lifting bar 22 when the device is lifted by the bar 22.

The plates may be conveniently secured to the lifting bar 22 by such means as conventional collars 20 which have set screws 26 that tighten against the lifting bar. The plates, because of their shape, are stable when set down on the floor. By contrast, conventional round weights will roll, creating a risk of damage or injury.

A leverage bar 28 extends longitudinally between the plates 10 and passes through the apertures 16 (FIG. 1) of the plates. A pair of retaining collars 18 are respectively mounted on the opposite ends of the leverage bar to prevent the bar from slipping out of the plates.

FIG. 4 depicts the exercise device being used in a curling or fly movement, with the lifting bar mounted in aperture 12 (FIG. 1). As evident from the illustrated hand, the Figure shows the device near the upper end of the movement. Returning momentarily to FIG. 1, it may be appreciated that the plates will tend to retain the illustrated orientation during the movement if the plate is symetrical on both sides of line 2—2. Specifically, each plate's center of gravity will seek to hang directly under the center of the aperture 12 throughout the curl or fly movement. Accordingly, the plates 10 rotate about the lifting bar to retain their orientation as the device is lifted along the acruate path of the curl or fly.

An outer tubular cover 24 circumventing the lift bar 22 may be provided between the weights. The tubular cover 22 is of slightly larger diameter than the lift bar, permitting the bar 22 to rotate with the plates 10 while the cover 24 is gripped by the user. Accordingly, the user's grip is undisturbed as the plates rotate about the bar 22.

As shown in FIG. 4, however, the leverage bar 28 extending between the plates prevents the plates 10 from rotating towards the user during the top portion of the movement. Because the leverage bar rotates with the plates about the lifting bar, it contacts the user's outer forearm 30 and prevents the plates from swinging inwardly towards the user. The plates' centers of gravity are accordingly held in a lagging position with respect to the user's hand, and thereby continue to exert a torque against the user's biceps.

As shown in FIG. 5, the lifting bar 22 may also be mounted in aperture 14 at the plate's center of gravity, and the leverage bar 28 removed, thereby permitting the device to function as a conventional barbell.

FIG. 7 shows the use of the exercise device in a lateral raise. The purpose of a lateral raise movement is to exercise the shoulder muscles. However, conventional barbells place a heavy strain on the user's grip and wrist and these muscles usually before the shoulders. As shown in FIG. 7, the user lifts the subject device by the lifting bar 22, and rotatingly flips the weights so that the leverage bar 28 rests on the outer forearm 30. As the device is raised laterally, the substantial portion of the plates' weight is supported by the user's forearm 30, thereby efficiently working the shoulder muscles.

As evident from FIG. 3, the illustrated embodiment of the apparatus requires a leverage bar 28 of sufficient length to enable a foreseeable maximum number of weight plates to be mounted at both ends. Accordingly, a leverage bar of maximal length is utilized, despite the fact that less than the maximum number of weight plates will typically be used.

Figure 9:
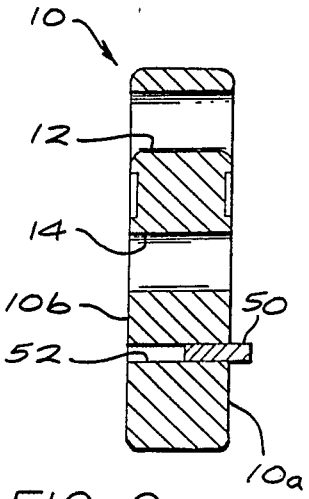
FIG. 9 is a cross section of the weight plate of FIG. 8 taken along line 9—9; and, FIG. 10 is a front elevation view of a second embodiment of an exercise device constructed in accordance with the invention.

The foregoing matter is addressed by a second embodiment of the weight plate, illustrated in section in FIG. 9. The weight plate illustrated in FIG. 9 is similar to that illustrated in FIG. 2, except that the front face **10*a* includes a first discontinuous surface feature in the form of a generally cylindrical protrusion 50, while the back face 10*b* of the plate 10 includes a second discontinuous surface feature in the form of an aperture 52. The aperture 52 is sized and positioned to interengage a protrusion 50 of an adjacently mounted weight plate, when the weight 10** is mounted on the lifting bar of the apparatus.

Figure 10:
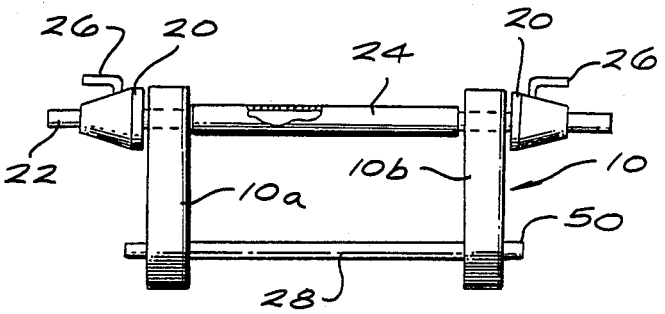

In the illustrated embodiment of FIG. 10, the leverage bar may conveniently be of a length which enables it to extend into only the innermost plate on each end of the apparatus. The protrusion 50 and aperture 52 are preferably co-axially aligned with the leverage bar 28, so that the leverage bar appears to protrude slightly from the outermost of the adjacently mounted plates, despite the fact that its actual length is only sufficient to penetrate the innermost plate at each end of the apparatus. Accordingly, a leverage bar of only minimal length is required, regardless of the number of adjacently mounted weight plates coupled to its ends.

It will be recognized that the adjacently mounted weight plates will rotate in unison about the lifting bar 24 by virtue of the interlocking protrusions 50 and apertures 52. Thus, each of the adjacently mounted plates remains coupled to the leverage bar for rotation therewith, despite the fact that the leverage bar penetrates only the innermost plates. Preferably, the protrusion 50 is approximately one-half the thickness of the weight plates, or slightly less, so that it may be wholly received within a neighboring aperture without interfering with the facial abutting of the adjacently mounted weight plates.

While the foregoing description of the preferred embodiment is specific in its detail, it is recognized that variations and is specific in its detail, it is recognized that variations and modifications may be made by those skilled in the art having the benefit of these teachings. It is therefore intended that the invention be defined by the appended claims and that the claims be interpreted as broadly as permitted by the prior art to include equivalent embodiments.

I claim:

1. For use with an exercise apparatus of the type comprising (a) a pair of longitudinally separated weight plates for providing a movable weight-training mass and 5 having respective centers for gravity;

(b) a generally cylindrical lifting bar extending generally longitudinally between the weight plates and mounted thereto at first respective locations on the plates offset from said respective centers of gravity;

(c) means for permitting rotation of the weight plates about the lifting bar as the apparatus is moved by a user; and (d) a leverage bar extending generally longitudinally between the pair of weight plates and mounted thereto for rotation therewith at respective second locations on the weight plate means different from the respective first locations, the leverage bar being positioned to rotate with the weight plates about the lifting bar so as to contact the outer forearm of the user during the exercise movement, a weight plate having front and back faces, the faces being generally symmetrical about respective first axes of symmetry and being asymmetrical about respective second axes, the first and second axes associated with each face being relatively orthogonal, the points of intersection of the two sets of first and second axes being co-linear with the plate's center of gravity, the plate including first mounting means for mounting the weight plate to a lifting bar, said first mounting means being located with respect to at least one face at a first position on said first axis and offset from the from the intersection of the face's first and second axes, a first discontinuous surface feature associated with one of the front and back faces, and a second discontinuous surface feature associated with the other of the front and back faces, the first and second surface features being respectively interengagable with corresponding second and first features of adjacent weight plates on the apparatus to cause the plates to move in general unison about the lifting bar.

2. The weight plate of claim 1 wherein the faces are generally triangular.

3. The weight plate of claim 1 wherein the first mounting means includes a throughhole through the plate in communication with the faces.

4. The weight plate of claim 1 including second mounting means located at a second position on at least one face of the plate for receiving an end of the leverage bar, the second position being remote from the first axis associated with the face and being seperated from the first mounting means by the second axis.

5. The weight plate of claim 1 wherein the first discontinuous surface feature includes a generally cylindrical protrusion extending from one of the plate's faces, and of sufficient length to extend through a portion of the thickness of an adjacent plate on the apparatus.

6. The weight plate of claim 5 wherein the second discontinuous surface feature includes a hole formed in the other of the plate's faces to accept the corresponding protrusion of an adjacent plate on the apparatus, the hole being of sufficient depth to permit facial abutment of the adjacent plates.

7. The weight plate of claim 6 wherein the positions of the protrusion and the hole on the opposite faces of the plate are co-axially aligned.

8. The weight plate of claim 6 wherein the depth of the hole is approximately one-half the thickness of the plate.

9. The weight plate of claim 6 wherein the hole is positioned for receipt of the leverage bar when the plate is mounted on the lifting bar as an innermost plate.

10. A weight plate for use with a barbell type exercise apparatus comprising:

a mass of material having generally triangularly shaped front and back faces, the weight plate including a first through hole located near one of the three corners of the plate for mounting the weight plate to a lifting bar, a protruding region extending generally perpendicularly from one of the plate's faces, and a recess formed on the other of the plate's faces and of generally complimentary shape with respect to the protrusion so that the respective protruding surfaces and recesses of adjacent like weight plates are interengagable with each other.

11. The weight plate of claim 10 wherein the recess is an aperture having a depth of less than the thickness of the plate, and a cross-section slightly greater than the corresponding cross section of the protrusion.

12. The weight plate of claim 10 further including a second throughhole positioned near a second corner of the plate.

* * * * *